US007431535B2

(12) United States Patent
Cupolillo

(10) Patent No.: US 7,431,535 B2
(45) Date of Patent: Oct. 7, 2008

(54) CLAMP FOR ANCHORING PRODUCTION TUBE, ELECTROHYDRAULIC HOSE AND ELECTRIC CABLE SIMULTANEOUSLY

(75) Inventor: Gilmar Souza Cupolillo, Rio de Janeiro (BR)

(73) Assignee: IPBGR Indústria Mecânica LTDA, Rio de Janeiro (BR)

( * ) Notice: Subject to any disclaimer, the term of this patent is extended or adjusted under 35 U.S.C. 154(b) by 318 days.

(21) Appl. No.: 11/267,573

(22) Filed: Nov. 7, 2005

(65) Prior Publication Data

US 2007/0231074 A1 Oct. 4, 2007

(30) Foreign Application Priority Data

Nov. 5, 2004 (BR) ..... 0404834

(51) Int. Cl.
*F16L 33/02* (2006.01)
*F16L 1/06* (2006.01)

(52) U.S. Cl. ..... 405/184.4; 405/211; 405/303; 166/241.1; 166/243; 24/20 R

(58) Field of Classification Search ..... 24/16 R, 24/20 R–20 W; 405/195.1, 211; 166/241.1, 166/241.6, 243
See application file for complete search history.

(56) References Cited

U.S. PATENT DOCUMENTS 3,402,436 A * 9/1968 Oetiker ..... 24/20 R
4,426,754 A * 1/1984 Smith et al. ..... 24/17 AP
4,451,955 A * 6/1984 Kern et al. ..... 24/20 CW
4,454,644 A * 6/1984 Okazaki et al. ..... 29/440
4,637,097 A * 1/1987 Secord ..... 24/16 PB
4,675,949 A * 6/1987 DaCosta ..... 24/269
5,170,540 A * 12/1992 Oetiker ..... 24/284
2003/0159255 A1* 8/2003 Senovich et al. ..... 24/20 R
2004/0261227 A1* 12/2004 Cassel et al. ..... 24/20 R

* cited by examiner

*Primary Examiner*—Tara L. Mayo
(74) *Attorney, Agent, or Firm*—Hunton & Williams, LLP

(57) ABSTRACT

A clamp is disclosed for use in deep sea oil exploration operations. The clamp includes a pre-formed metallic belt (12) to which a first rigid metallic curve (13) is welded. The rigid metallic curve reinforces and protects the anchorage housing of an electro-hydraulic hose which is secured by the clamp. The belt (12) further includes a second rigid metallic curve (14) to reinforce and protect an electric cable which is secured by the clamp. The belt includes rigid symmetrical forks (15) and (16) that are welded in the rotation area of screws that serve to tighten the clamp. The clamp includes a body made of vulcanized rubber having three tips (26), (27) and (28), which are formed at equidistant angles of 120°. The clamp body includes a larger bore hole in the center (17), a medium bore hole in half oblong form (9) in the tip (27), a small bore hole in half oblong form (8) in the tip (26), and a bore slot (18) in the tip (28) suitable for the opening and closing of the clamp (1). The clamp body further includes a small bore hole (10) located in one side of said slot (18), where two threaded casters (2) are set up having a smaller diameter than the hole (18) in order to make the caster (2) pivotable inside of the hole (18).

6 Claims, 4 Drawing Sheets

CLAMP FOR ANCHORING PRODUCTION TUBE, ELECTROHYDRAULIC HOSE AND ELECTRIC CABLE SIMULTANEOUSLY

This application claims priority to Brazilian Application No. P10404834-2, filed Nov. 5, 2005, which is hereby incorporated by reference in its entirety.

FIELD OF INVENTION

The present invention refers to an improved clamp. The clamp may be used in deep sea oil search operations to anchor electro-hydraulic, electric or hydraulic hoses at production tube columns during installation and removal operations of sub sea Christmas trees (ANM). The clamp may include a housing to anchor the production tube, the electro-hydraulic cable, and the electric cable simultaneously, while also acting as a production tube column centralizer, presenting excellent impact strength, great flexibility, and low maintenance cost.

BACKGROUND OF THE INVENTION

In preparation operations for oil exploration in deep sea wells, several production tubes coiled to each other descend from the platform. These tubes may be used to drain product or transport equipment involved in the operation up to and down from the platform. Clamps may be installed at the production tube to simultaneously anchor the production tube, an electro-hydraulic hose, and an electric cable.

The clamp anchors the electro-hydraulic hose and the electric or hydraulic cable at the production tube, with a 50 lbs·ft of torque, in order to avoid the compression of hydraulic lines, and to protect them of possible damages to the rubber lining, during the descent and ascent of the production tubes. The clamps may be inserted inside of another larger tube, whereby the external diameter of these clamps has friction with the internal diameter of the larger tube during the descent and the ascent of the production tubes. In the area between the internal diameter of the larger tube and the external diameter of the production tube, there is a chemical compound with great abrasive power, which acts as a hydrate formation inhibitor, in the area of the wellhead.

The clamps currently used present several problems during operation due to the process which involves very considerable values of potential energy and friction forces as well as chemical attack to the clamp material. All these factors acting during the operation make the clamp currently used very vulnerable to fractures and chemical attacks due to its mechanical construction. The clamp may include a blanket of vulcanized rubber in the metal with the purpose of ensuring a suitable tightness and avoiding the sliding of the clamp fitted on the tube. The clamp is tightened by means of screws and casters, with a 50 lbs·ft torque, using a pneumatic impact wrench. In the clamp used currently there are equidistant metallic plates screwed in the metal body 90 degrees apart, aimed to promote friction with the inner wall of the larger tube, protecting the metal body and, consequently, the electro-hydraulic hose and the electric cable. However, due to clamp shocks many of these wearing plates become loose, falling in the bottom of the well. Another problem is that the clamp is inflexible, being made with no ductile materials, and does not absorb small impacts that usually occur against the fixed parts of other equipment involved in the operation. This can cause the clamp to break, and metal parts to subsequently fall to the bottom of the well resulting in damage and lost time. Another problem is the heavy maintenance demands after use which require washing with fresh water under pressure, and immediately lubricating movable parts. Further, the use of metals with different characteristics being assembled to the clamp and having different electric potentials may result in a galvanic pile being formed in a marine environment.

The clamp currently used presents several problems, which makes the equipment very fragile prior to an operation involving loads with great mass and considerable mechanical demands. Therefore, an objective of the present invention is to present a improved clamp with high level of safety and very low maintenance schedule. After several studies and tests in field, a clamp has been developed wherein the whole body is made of rubber, making it unbreakable after a fall, and extremely resistant to chemical attacks in marine environments.

In an embodiment, the invention involves a clamp for simultaneously anchoring the production tube, the electro-hydraulic hose, and the electric cable for use in deep sea oil search and production operations, in the production tube column in installation and uninstalling operations of sub sea Christmas trees (ANM), and with housings to simultaneously anchor the production tube, the electro-hydraulic cable and the electric cable, while also acting to centralize the production tubes into a column. The clamp includes a pre-formed metallic belt (12) to which a first rigid metallic curve (13) is welded. The rigid metallic curve reinforces and protects the anchorage housing of an electro-hydraulic hose, which is secured by the clamp. The belt (12) further includes a second rigid metallic curve (14) to reinforce and protect the electric cable which is secured by the clamp. The belt includes rigid symmetrical forks (15) and (16) that are welded in the rotation area of screws that will tighten the clamp. The clamp includes a body made of vulcanized rubber having three tips (26), (27) and (28), which are formed at equidistant angles of 120°. The clamp body includes a larger bore hole in the center (17), a medium bore hole in half oblong form (9) within said tip (27), a small bore hole in half oblong form (8) within the second tip (26), and a bore slot (18) within the third tip (28) suitable for the opening and closing of said clamp (1). The clamp body further includes a small bore hole (10) located in one side of said slot (18), where two threaded casters (2) are set up having a smaller diameter than said hole (18) in order to make said caster (2) pivotable inside of said hole (18). In another aspect, the caster (2) is threaded with a screw (4) having a washer (3), in which a safety ring (5) is set up at the end to avoid the disassembly of the screw (4) in the counter-torque of clamp opening. In another aspect, the after welding the belt (12) curves (13) and (14), and forks (15) and (16) is complete, the rubber body of the clamp (1) is produced by vulcanization.

DESCRIPTION OF THE DRAWINGS

Other objectives, characteristics, and advantages of the present invention will become more apparent from the following detailed description when view together with the accompanying drawings to the present specification, in which.

DETAILED DESCRIPTION OF THE INVENTION

Figure 1:
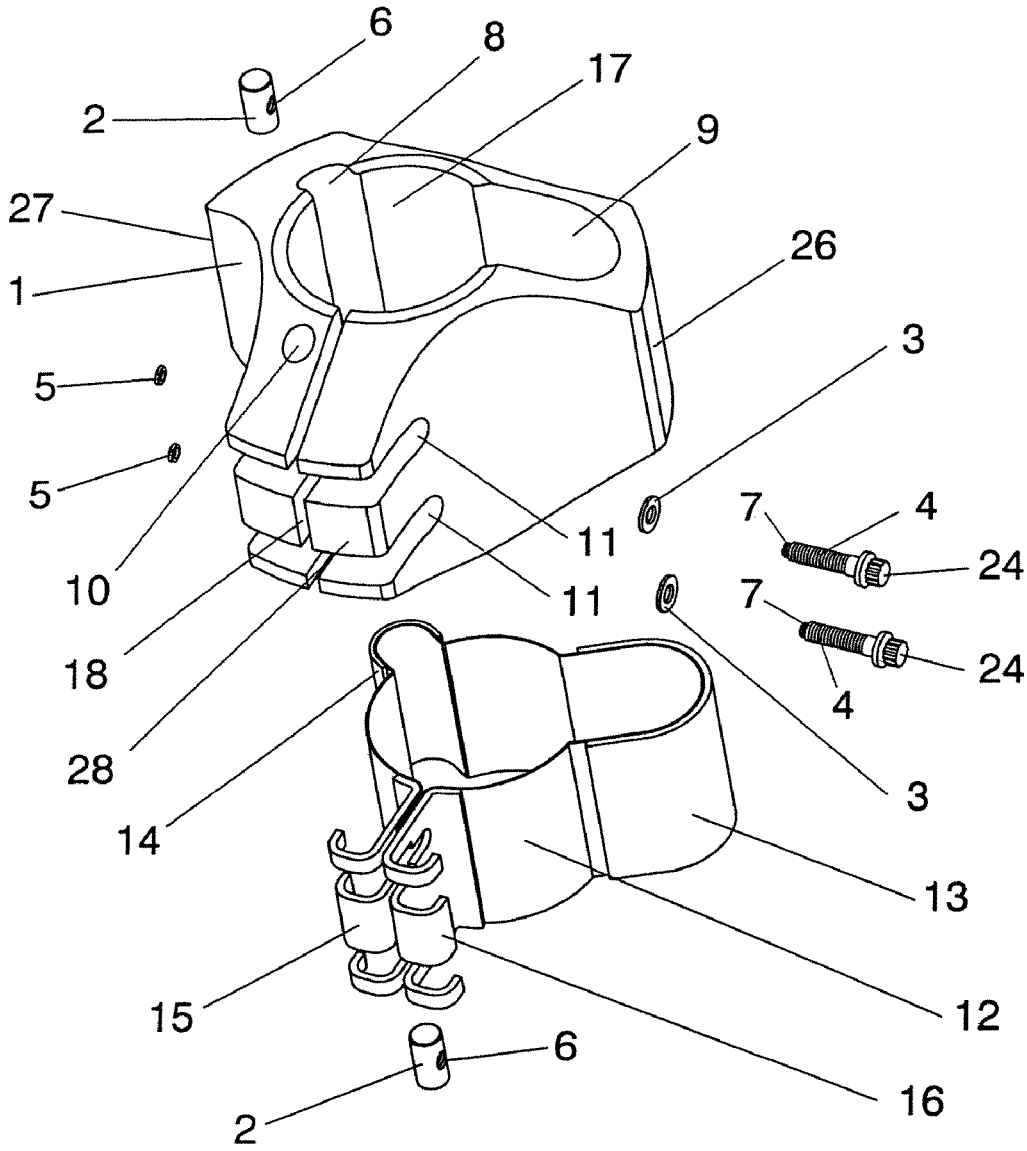
FIG. 1 is an exploded perspective view showing the overall clamp structure.
Figure 2:
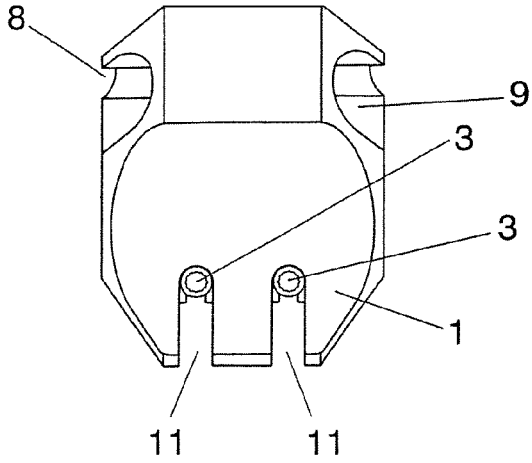
FIG. 2 is a drawing in a lateral plan view, showing the two tighten screws, clamp housings, and external form.

As observed from the Figures in that identical numeric references identify corresponding parts, the present invention involves a clamp 1 having geometry that allows the centralization of the column into the diameter tube. In an embodiment, the clamp utilizes nitrilic rubber in the external lining allowing a better strength to shock and impact in cases of collisions against other baffle plates, with the further advantage that nitrilic rubber presents a satisfactory strength against sea water and to other chemical compounds.

The improved clamp 1 is manufactured from a preformed metallic belt 12 in which a rigid metallic curve 13 is welded to reinforce and protect the anchorage housing of the electro-hydraulic hose. The belt 12 includes a rigid metallic curve 14 joined to it to reinforce and protect the anchorage housing of the electric cable to the belt 12. Rigid symmetrical forks 15 and 16 are welded in the rotation area of the screws that work to tighten the screws and improve the strength of the clamp in that area. After the welding process of the belt 12, and the curves 13 and 14, and forks 15 and 16 is accomplished, the vulcanization to produce the rubber body of the clamp 1 is performed.

To operate the clamp 1, two casters 2, which are treated to support high torque, are introduced in the hole 10. The casters provide rotational movement inside of the hole. The casters also providing rotation movement to the screws 4 around the axis of the caster 2, allowing the opening and closing of the clamp 1. The screws 4 receive two washers 3 that will act as a sliding surface for the screw head 24 during the torque application to tighten the clamp 1 using a pneumatic impact wrench. After the assembly of the washers 3 in the screws 4, the screws 4 are threaded into the casters 2. Locking rings 5 may be provided in the tip of the screws 4, which may include a housing 7 designed to interface with the locking rings, to prevent disassembly of the screw 4 from the caster 2 when the screws are subjected to a counter-torque when the clamp is opened thereby acting as a safety device during operation.

The improved clamp 1 provides specific advantages for use in support operations for oil searching in the deep sea, with the objective of anchoring simultaneously the production tube 6 in a large, central hole 17, the hydraulic hose 25 in a medium hole 9, and the electric cable in a small hole 8. The clamp is then fastened with screws 3, which are pivoted and then tightened with a torque value about 50 lbs·ft.

In an embodiment of the invention, clamp 1 is manufactured with 90% nitrilic rubber with density 1.18, which is capable of floating when immersed in well fluid, and resists impact and chemical attacks originating from of the completion operations of underwater wells. Alternatively, the clamp 1 may be manufactured from engineering plastic material.

In an embodiment of the invention, clamp 1 supports the installation in depths of about 2500 meters in water, while resisting the crushing pressures of about 256 $kgf/cm^2$ throughout its whole body.

Figure 3:
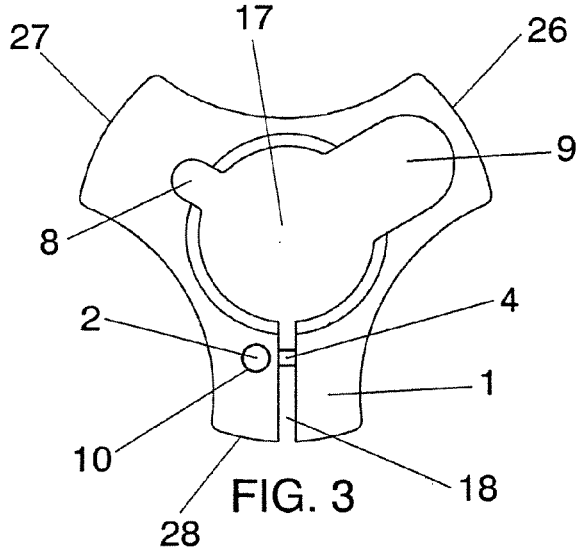
FIG. 3 is a drawing in plan view showing the clamp form and the fixation housings of the production tube, electro-hydraulic hose, and the electric cable, while also showing the opening of the clamp and the tightening mechanism.
Figure 4:
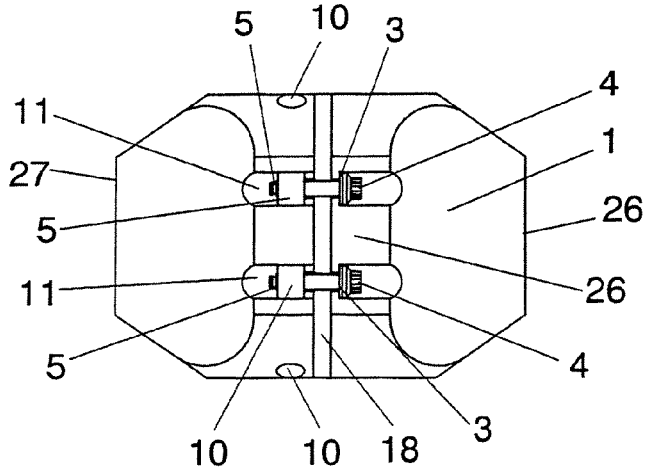
FIG. 4 is a drawing in frontal plan view showing the whole clamp tightening mechanism as well as the symmetry in the clamp drawing.
Figure 5:
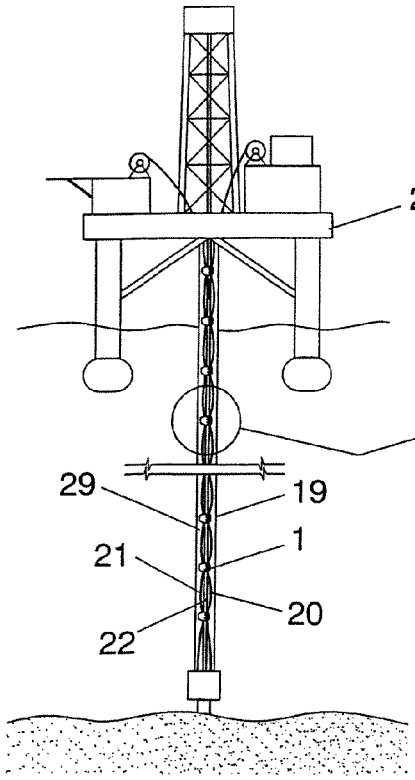
FIG. 5 is a plan drawing showing a complete oil well operation with the clamps being used with all of the implications involved in the operation, in this case the clamps are surrounded by a larger diameter tube along the column.
Figure 6:
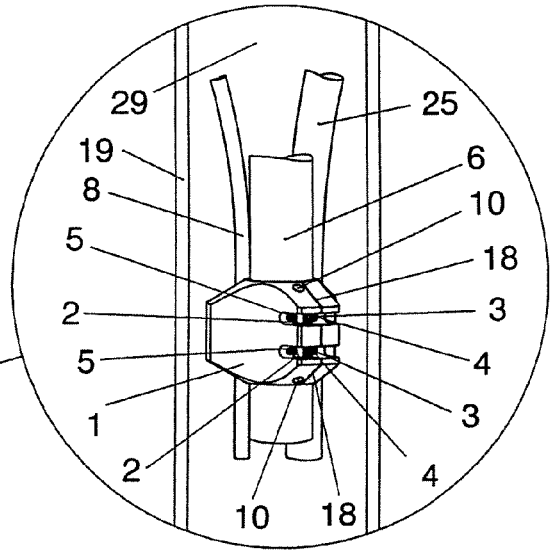
FIG. 6 is a perspective drawing in detail enlarged from the FIG. 5, to better show the assembly of the clamp at the production tube, the fastening of the electro-hydraulic hose and the electric cable, and also showing the larger diameter tube which surrounds the clamps along the column. In this detail it is also possible to visualize how the entire ANM set, production tube, and larger diameter tube stay fixed at the bottom of the sea connected to the wellhead despite the platform flotation and longitudinal and traverse movements of whole column caused by sea waves, which result in friction forces and drag between the larger diameter tube and the clamps.
Figure 7:
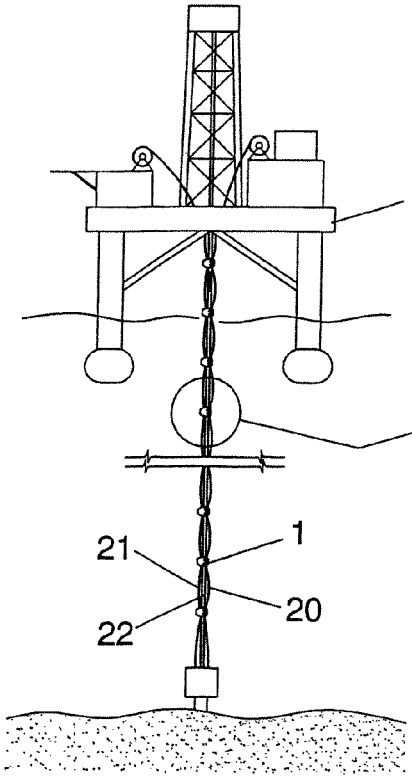
FIG. 7 is a plan drawing showing an operation in open sea of descent or ascent of submerged equipments in an oil well, with the clamps being used with the implications that involve the operation, in this case with the tube surrounding the clamps, wherein the clamps are in direct contact with the sea water along the column. However in this operation mode there are sea currents in all directions, which may co-operate to open the clamps due to the force of currents acting on the electro-hydraulic hose and the electric cable.
Figure 8:
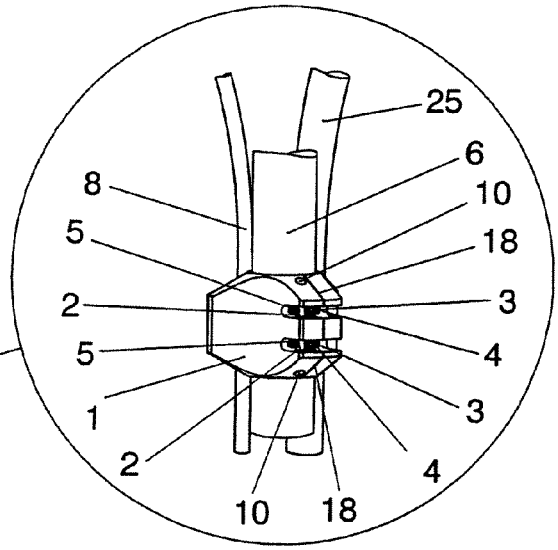
FIG. 8 is a enlarged perspective drawing from FIG. 7, with the objective of better showing the clamp assembly in the production tube, fastening the electro-hydraulic hose and the electric cable.
Figure 9:
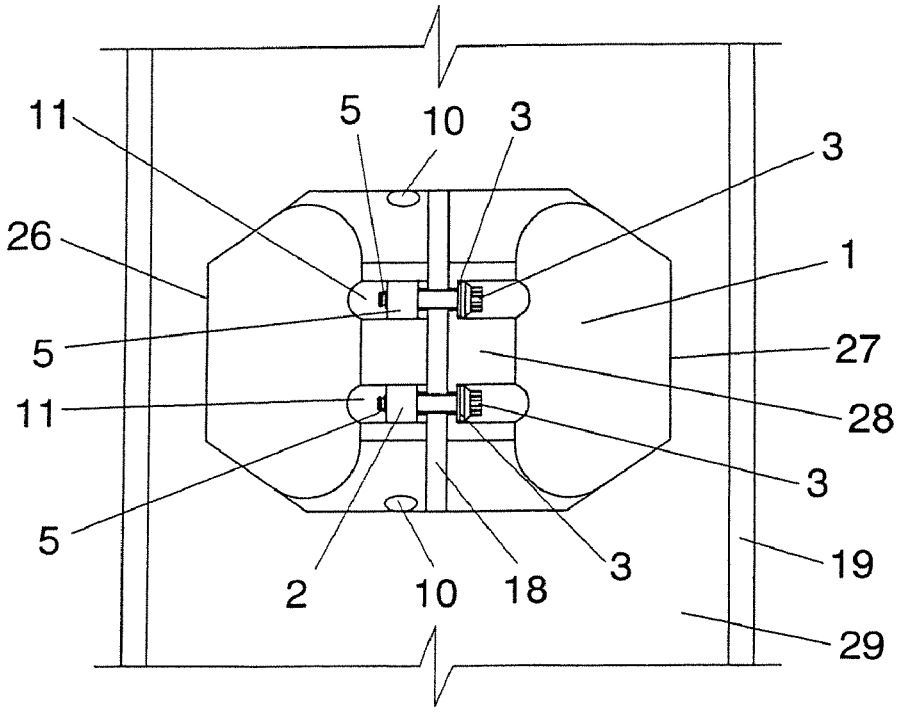
FIGS. 9 and 10 are respectively drawings in the frontal plan view showing the larger diameter tube crossed, which involves the clamp in an operation of descent or ascent of the production tubes. This drawing shows in a clear way an improvement of the invention that is the centralization of the production tubes in the column, through the clamps, to minimize space between the external faces of the clamp and the larger diameter tube that surrounds them.
Figure 10:
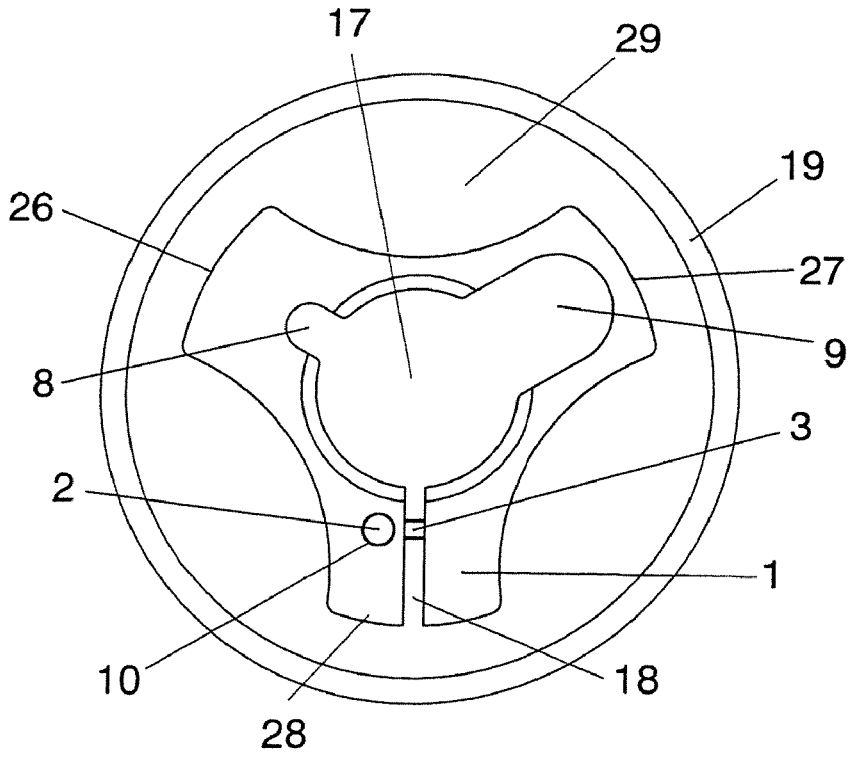

In an embodiment of the invention, clamp 1 provides a geometric form (FIG. 3) allowing the centralization into production tubes into a column. FIGS. 9 and 10 depict the clamp inserted into the column having a larger diameter 19 than the tubes. In an embodiment of the invention, the tips 26, 27 and 28 are designed to minimize wear caused by friction between the clamp and the inner wall of the larger tube 19.

The invention claimed is:

1. A clamp for anchoring a production tube, electro-hydraulic hose, and an electric cable comprising:

a metallic belt;

a first rigid metallic curve attached to the belt;

a second rigid metallic curve attached to the belt;

a first rigid fork and a second rigid fork adapted to accept fasteners for tightening the clamp;

a clamp body comprising a first tip, a second tip, and a third tip spaced at 120° angles from each other, wherein the clamp body comprises a centrally located first bore hole, a second bore hole in half oblong form projecting toward the first tip and aligned with the first rigid metallic curve, a third bore hole in half oblong form projecting toward the second tip and aligned with the second metallic curve, and a bore slot aligned with the first and second rigid forks for opening and closing the clamp.

2. The clamp of claim 1, wherein the clamp body comprises a fourth bore hole located adjacent the bore slot for accepting at least one caster, wherein the caster is threaded to accept a screw for tightening the clamp.

3. The clamp of claim 1, wherein the clamp includes a caster located within the bore hole that is threaded to accept a screw, and the screw includes a safety ring set up at the end to prevent disassembly.

4. The clamp of claim 1, wherein the clamp body comprises vulcanized rubber.

5. The clamp of claim 4, wherein the clamp body comprises nitrile rubber.

6. The clamp of claim 5, wherein the clamp body comprises 90% nitrile rubber and is capable of floating when immersed within well fluid.

* * * * *